United States Patent [19]

Bartel et al.

[11] 4,027,917

[45] June 7, 1977

[54] METHOD FOR IGNITING THE TOP SURFACE OF OIL SHALE IN AN IN SITU RETORT

[75] Inventors: William J. Bartel; Robert S. Burton, III, both of Grand Junction, Colo.

[73] Assignee: Occidental Petroleum Corporation, Los Angeles, Calif.

[22] Filed: May 16, 1975

[21] Appl. No.: 578,203

[52] U.S. Cl. ..... 299/2; 166/259; 166/260

[51] Int. Cl.[2] ..... E21B 43/24; E21B 43/26

[58] Field of Search ..... 299/2, 3, 4, 14; 166/256, 247, 259, 260

[56] References Cited

UNITED STATES PATENTS

| | | | |
|---|---|---|---|
| 1,919,636 | 7/1933 | Karrick | 299/2 |
| 3,001,775 | 9/1961 | Allred | 166/259 X |
| 3,017,168 | 1/1962 | Carr | 299/2 |
| 3,537,528 | 11/1970 | Herce et al. | 166/247 |
| 3,601,193 | 8/1971 | Grady | 166/259 X |
| 3,620,301 | 11/1971 | Nichols et al. | 166/247 X |
| 3,661,423 | 5/1972 | Garret | 299/2 |
| 3,692,110 | 9/1972 | Grady | 166/259 X |
| 3,765,477 | 10/1973 | Huisen | 166/247 X |

*Primary Examiner*—Stephen J. Novosad
*Assistant Examiner*—George A. Suchfield
*Attorney, Agent, or Firm*—Christie, Parker & Hale

[57] ABSTRACT

An in situ oil shale retort is ignited by directing a combustible inlet gas mixture into an ignition zone extending across the top of the in situ retort and igniting the combustible mixture to create a combustion zone in the in situ retort. The ignition zone has a sufficient volume of interconnected open spaces for the movement of inlet gas through the ignition zone with minimal pressure loss, and the in situ retort below the ignition zone has sufficient void volume that inlet gas can be introduced into the ignition zone and moved downwardly through the in situ retort to the bottom. After ignition of the combustible mixture, additional quantities of a combustible mixture are directed into the ignition zone to maintain the combustion zone. Flue gases generated in the combustion zone are moved from the combustion zone toward the bottom of the in situ oil shale retort to establish a retorting zone on the advancing side of the combustion zone. When a self-sustaining combustion zone is established, introduction of combustible mixture can be terminated and an oxygen supplying gas introduced.

18 Claims, 1 Drawing Figure

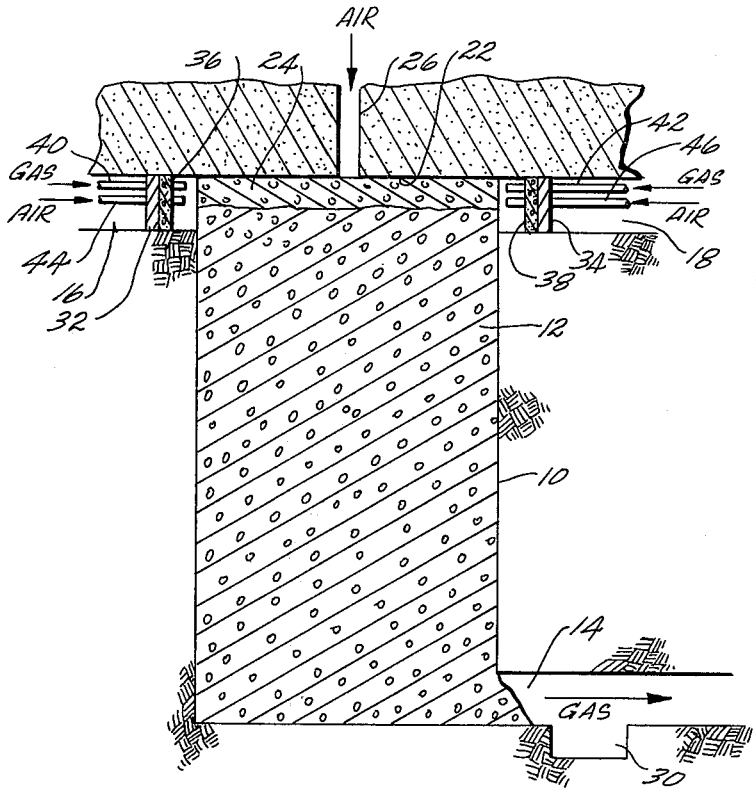
AIR
36
24
26
22
40
GAS
AIR
42
46
GAS
AIR
44
16
32
38
34
18
12
10
14
GAS
30

METHOD FOR IGNITING THE TOP SURFACE OF OIL SHALE IN AN IN SITU RETORT

FIELD OF THE INVENTION

This invention relates to processing of oil shale, and more particularly, to a method of igniting the oil shale in an in situ retort.

BACKGROUND OF THE INVENTION

A basic technique for retorting oil shale which occurs in vast deposits throughout the world is to heat the oil shale in an oxygen-free atmosphere to a temperature of about 900° F. to convert kerogen to liquid and gaseous products. This basic retorting process has been carried out by mining the oil shale, either by underground or open pit mining, and carrying the oil shale to large retorts where it is heated and the kerogen converted to liquids and gases. An alternative approach which has significant economic advantages and much less environmental impact involves retorting the oil shale in situ. The in situ retort is generally a subterranean cavity or chamber filled by an expanded mass or "rubble pile" of fragmented mass of oil shale particles. The cavity and fragmented mass of oil shale particles can be formed by explosive techniques. The in situ retort is ignited at the top and burned downwardly by an oxygen supplying inlet gas introduced at the top of the in situ retort and withdrawn from the bottom. A combustion zone is formed and moves downwardly through the in situ retort as gas moves from the top to the bottom of the in situ retort. The gases from the combustion zone are at a sufficient temperature to heat the oil shale below the combustion zone to the necessary temperature to convert the kerogen to liquids and product gases. The retorted oil shale contains sufficient carbonaceous materials to sustain combustion when contacted by oxygen.

As discussed in more detail in copending application Ser. No. 536,371, filed Dec. 26, 1974, now abandoned entitled "Method for Assuring Uniform Combustion in In Situ Oil Shale Retorts," by Chang Yul Cha and assigned to the same assignee as the present invention, maximum recovery efficiency is achieved when the combustion zone moves downwardly through the retort as an approximately planar and preferably horizontal combustion zone. Ignition of the rubble pile of fragmented shale has been obtained by burning a combustible gas with air or other oxygen supplying gas and impinging the flame downwardly at the top of the rubble pile through a conduit which admits gas into the top of the cavity. Even where there is more than one ignition area at the top, ignition may not be uniform and burning takes place unevenly throughout a substantial portion of the in situ oil shale retort. While the combustion zone tends to become more planar as the combustion zone advances downwardly, pockets of unburned or unheated oil shale may remain, reducing the overall efficiency of the retorting operation.

SUMMARY OF THE INVENTION

The present invention is directed to a method of igniting an in situ oil shale retort in a manner to establish a uniform combustion zone throughout an ignition zone extending across the top of the in situ retort. The in situ oil shale retort has a sufficient void volume below the ignition zone that gas introduced into the ignition zone can be moved to the bottom of the in situ retort. The ignition zone has a sufficient volume of interconnected open space for the movement of inlet gas through the ignition zone with a minimal pressure loss.

The combustion zone is established by directing a combustible inlet gas mixture of fuel and oxygen supplying gas horizontally across the ignition zone and igniting the combustible mixture. The combustion zone is maintained by directing additional quantities of combustible mixture horizontally into the ignition zone. Flue gases generated in the combustion zone are caused to move from the combustion zone toward the bottom of the in situ retort to establish a retorting zone on the advancing side of the combustion zone.

DESCRIPTION OF THE DRAWINGS

For a better understanding of the invention, reference should be made to the single FIGURE which is a semi-schematic vertical cross-sectional view of an in situ cavity.

DETAILED DESCRIPTION

Referring to the drawing in detail, the numeral 10 indicates an in situ retort in a subterranean oil shale formation. The in situ retort is a cavity bounded by walls of essentially undisturbed oil shale and substantially filled, with a fragmented mass of oil shale particles 12. The in situ retort filled with fragmented oil shale particles can be formed in the manner described in U.S. Pat. No. 3,661,423, or any of a variety of other techniques. Access to the bottom of the in situ retort 10 is provided through a horizontal access tunnel 14 at the bottom of the in situ retort. The tunnel 14 is first formed in the shale formation and a portion of the shale is then removed through the tunnel to form an open space in the formation which defines the bottom or floor of the in situ retort. Oil shale above this open space is then blasted with explosives to form the cavity and to fill the cavity with the fragmented oil shale.

In practice of one embodiment of the present invention, additional access tunnels 16 and 18 are formed at the top of the cavity 10 which permits access to the top of the fragmented oil shale 12. Relatively small passages or conduits may also suffice. Fragmented oil shale particles are either removed or added, if need be, to the in situ retort to form an ignition zone 24 extending across the in situ retort below the ceiling 22 of the cavity. The ignition zone has a sufficient volume of interconnected open space for movement of inlet gas through the ignition zone with a minimum pressure loss. The ignition zone 14 is connected through a conduit 26 to the ground surface to permit air or other oxygen supplying gas to be introduced through the conduit 26, preferably under a positive pressure, generally resulting in a downward flow of gas through the fragmented oil shale particles 12 in the cavity. Retort off gas is withdrawn at the bottom through the lower tunnel 14. The pressure differential between the top and bottom of the retort is sufficient for causing the inlet gas to flow through the fragmented oil shale in the in situ retort. This pressure differential can be formed at least in part by forcefully withdrawing gas from the bottom of the retort as well as by forcefully adding gas at the top.

The retorting process is carried out by igniting the oil shale at the top of the fragmented oil shale particles 12 and utilizing the heat of combustion to heat the oil shale particles below the combustion zone. As the combustion zone moves downwardly through the in situ retort, the fragmented oil shale below the combustion zone is heated by gas moving through the combustion zone to form a retorting zone on the advancing side of the combustion zone. In the retorting zone, the kerogen is at least partially decomposed to produce liquids and product gas. The liquids produced in the retorting zone are collected in a sump 30 in the tunnel 14 while the retort off gases including flue gas and product gas are withdrawn through the tunnel 14.

It has been proposed to ignite the oil shale by a flame from a localized source, such as at the bottom of the central conduit 26. This initially heats the fragmented oil shale in that region to a sufficient temperature to sustain burning in the presence of oxygen. Once the self-ignition temperature of carbonaceous material in the shale is reached, the combustion zone proceeds downwardly and outwardly through the in situ retort as oxygen is supplied. It has been difficult in the past to establish a uniform combustion zone across the complete horizontal extent of the in situ retort and to move the combustion zone downwardly at a uniform rate over the entire cross-sectional area. Since a localized combustion zone moves downwardly and outwardly, the upper edges of the fragmented shale in the in situ retort may not be ignited and are bypassed by the retorting zone, thereby reducing the yield of liquids and product gases from the in situ retort.

In order to achieve more uniform and complete retorting, a combustible inlet gas mixture is directed across the ignition zone 24 and is ignited to provide a combustion zone over substantially the entire top surface of the in situ retort 10. To this end, the tunnels 16 and 18 are blocked off by bulkheads 32 and 34 with the inside of the bulkheads lined with a refractory brick wall, as indicated at 36 and 38 to protect the bulkheads from intense heat within the ignition zone 24. Opposing jets direct a gaseous fuel horizontally into the ignition zone 24 through pipes 40 and 42 extending through the bulkheads 32 and 34, respectively, adjacent the top of the in situ retort. Opposing jets also horizontally direct an oxygen supplying gas into the ignition zone through pipes 44 and 46, also extending through the bulkheads 32 and 34, respectively. The gaseous fuel and oxygen supplying gas are mixed in the ignition zone to provide a combustible inlet gas mixture in the ignition zone.

The combustible inlet gas mixture is ignited by an electric spark or other suitable ignition means to provide a combustion zone across the top of the in situ retort. The opposing flames converge near the center of the ignition zone where additional inlet gas can be introduced through the conduit 26 to cause the flame to be agitated and spread throughout the entire volume of ignition zone 24. Thus the entire top of the fragmented oil shale 12 below the ignition zone 24 is heated to a temperature sufficient to sustain combustion of carbonaceous material in the oil shale. Once the combustion zone is self-sustaining, the supply of gaseous fuel and oxygen supplying gas directed horizontally into ignition zone 24 through the pipes 40, 42, 44, and 46 can be terminated and oxygen supplying gas introduced into the ignition zone 24 at the top of the in situ retort through the conduit 26 to sustain the combustion zone and to move the combustion zone uniformly downwardly through the in situ retort.

Although the kerogen in the in situ retort is decomposed to produce liquid and gaseous hydrocarbon products by the movement of hot gases from the combustion zone to the retorting zone on the advancing side of the combustion zone, sufficient carbonaceous material remains in the so called "spent" shale after the retorting zone moves therethrough to sustain combustion in the presence of oxygen supplying gas introduced through the conduit 26. If desired, the conduit 26 can be dispensed with and inlet gas for advancing the retorting zone through the in situ retort can be introduced through the horizontal conduits 44 and 46. Inlet gas from either the center conduit 26 or the side conduits 44 and 46 readily spreads throughout ignition zone 24 since the interconnected open spaces within the ignition zone offer low gas flow resistance as compared with the fragmented shale in the situ retort below the ignition zone. Uniform travel of the combustion zone downwardly from the ignition zone is thereby obtained.

It will be appreciated that by introducing the combustible mixture of inlet gases across the ignition zone, heating of the fragmented oil shale takes place almost simultaneously across the entire top of the fragmented oil shale below the ignition zone 24. Once ignited, a uniform combustion zone is maintained by the downward movement of hot gases from the combustion zone to the retorting zone on the advancing side of the combustion zone under the influence of flow of inlet gas introduced at the top of the in situ retort. Heating by burning a combustible mixture in the ignition zone for about one week or longer is preferred to assure that the combustion zone developed across the in situ retort is self-sustaining without added fuel.

The in situ oil shale retort is shown as having an ignition zone 24 extending across the top and a sufficient void volume in the fragmented shale below the ignition zone for introducing inlet gas into the ignition zone and moving the inlet gas to the bottom of the in situ retort. The ignition zone 24 has a sufficient volume of interconnected open space for movement of inlet gas through the ignition zone with a minimal pressure loss. A combustible inlet gas mixture of fuel and an oxygen supplying gas is directed horizontally across the ignition zone and is ignited to produce a combustion zone in the in situ oil shale retort. Additional quantities of the combustible inlet gas mixture are introduced into the ignition zone to maintain combustion throughout the ignition zone. The flue gases generated in the combustion zone are caused to move from the combustion zone toward the bottom of the in situ retort to establish a retorting zone on the advancing side of the combustion zone.

The fragmented oil shale in the in situ oil shale retort below the ignition zone has a void volume such that inlet gas can be introduced into the ignition zone and withdrawn from the bottom of the in situ retort. The void volume in the in situ retort is generally created by forming an open volume or void within the subterranean oil shale formation and placing explosives in the formation adjacent to the open volume to fragment the oil shale and to expand the oil shale into the open volume. It is desirable to form an in situ retort having an average void volume of about 10 to 20 percent of the volume of the in situ retort. An appropriate void volume for an in situ retort is selected such that inlet gas can be moved from the inlet to a withdrawal point without excessive energy requirements for pumping or blowing.

As an example, in an in situ retort having a height of about 500 feet with a gas inlet at the top and gas withdrawal point at the bottom and a void volume in the fragmented shale of about 10 percent of the volume of the in situ retort, the pressure loss between the top and the bottom may be as much as about 10 psig when moving the inlet gas through the in situ retort at about one to two standard cubic feet of inlet gas per minute per square foot of cross-sectional area of the in situ retort. In some subterranean oil shale formations, a pressure of greater than about 10 psig may cause leakage of gas from the retort. It is, therefore, desirable to provide an in situ retort having a void volume sufficient for the movement of inlet gas through a void volume sufficient for the movement of inlet gas through the in situ retort at a desired rate with a minimum pressure loss. It should also be noted that the void volume of an in situ retort below the ignition zone should be maintained at a minimum to reduce the mining costs involved in producing the in situ retort.

The ignition zone 24 has a high void volume compared to the average void volume of the in situ retort below the ignition zone. The void volume of the ignition zone should be sufficient for movement of inlet gas through the ignition zone with minimal pressure loss. This is provided so that inlet gas can be directed horizontally from the boundaries of the in situ retort across the ignition zone. If the ignition zone has a low void volume or if the height of the ignition zone is not sufficient, a combustible inlet gas directed horizontally into the ignition zone and ignited would not produce a combustion zone extending across the in situ retort. A void volume in the ignition zone of about 30 to 50 percent of the volume of the ignition zone is generally sufficient for producing a combustion zone extending across the ignition zone; however, higher void volumes are contemplated. It is also noted that void volumes within this range provide sufficient fragmented oil shale in the in situ retort to support the overburden.

The larger void fraction giving interconnected open space in the ignition zone may be provided by any of a number of techniques. One of the easier techniques is to provide a larger open space or void near the top than in other portions of the in situ retort before blasting. This gives a larger volume into which the oil shale can expand when fragmented, hence a larger void fraction in the ignition zone than in the balance of the in situ retort. If the volume is too large near the top, the fragmented oil shale may not completely fill the retort, leaving some open space over the top of the rubble pile. This permits uniform ignition but may not adequately support the overburden. Support of overburden becomes particularly important with large retorts having significant areas of otherwise unsupported ceiling. Another technique for forming the ignition zone comprises removing fragmented oil shale from within the ignition zone after blasting. Preferably such removal is from "channels" extending over the top of the rubble pile of fragmented oil shale so that there are some regions of large interconnected open space and other regions having lower void space providing support for the overburden. This provides substantial uniformity of ignition across the in situ retort and a uniform combustion zone.

The height of the ignition zone depends on the width of the in situ retort, with the necessary height increasing in proportion to the width. With a void fraction greater than about 30 percent of the volume of the ignition zone, a height of the ignition zone of about one to ten percent and preferably about five percent of the width of the in situ retort is sufficient for establishing a combustion zone throughout the ignition zone by horizontally directing a combustible inlet gas mixture into the ignition zone and igniting the combustible mixture.

The combustible inlet gas mixture is generally a mixture of propane or butane with sufficient air to produce a combustible mixture. Propane and butane are useful because of availability; however, natural gas, product gases from an oil shale retort or other fuels can be used. Air is a convenient source of oxygen supplying gas and is often used; however, it is sometimes necessary to adjust the oxygen content of air by mixing air with a gas having a lower oxygen content. This may be desirable where air is used as the inlet gas and the oxygen is not depleted before the inlet gas moves from the combustion zone to the retorting zone. The products generated in the retorting zone are easily oxidized and destroyed at the temperatures in the retorting zone.

Although certain preferred embodiments of this invention have been herein set forth to illustrate its basic principles, various modifications and changes may be effected without departure from such basic principles. Changes and innovations of this type are therefore deemed to be within the spirit and scope of this invention.

What is claimed is:

1. A method of igniting an in situ oil shale retort containing a fragmented mass of particles containing oil shale, said in situ oil shale retort having an ignition zone extending across the in situ retort and a sufficient void volume distributed through the fragmented mass below the ignition zone for introducing inlet gas into the ignition zone and moving the gas through the fragmented mass below the ignition zone toward the bottom of the in situ retort, and further wherein, the ignition zone contains a portion of the fragmented mass of particles having sufficient average void volume for movement of a volume of inlet gas through a volume of the portion of fragmented mass in the ignition zone with less pressure loss than for the movement of a comparable volume of gas through a comparable volume of fragmented mass below the ignition zone, which comprises the steps of:

directing a sufficient quantity of an ignited combustible mixture of fuel and an oxygen supplying gas horizontally into said ignition zone for producing a self-sustaining combustion zone across the in situ oil shale retort in the fragmented mass below the ignition zone and generating flue gas in the combustion zone; and causing the flue gases generated in said combustion zone to move from the combustion zone toward the bottom of the in situ oil shale retort for establishing a retorting zone on the advancing side of the combustion zone.

2. The method of igniting an in situ oil shale retort as recited in claim 1 wherein said flue gases are caused to move from the combustion zone toward the bottom of the in situ retort by introducing an inlet gas downwardly into the ignition zone with sufficient pressure differential between the top and bottom of the in situ retort to move the downwardly introduced inlet gas through the combustion zone and through the fragmented mass of particles in the in situ retort below the ignition zone.

3. The method of igniting an in situ oil shale retort as recited in claim 1 wherein combustion is maintained in the ignition zone by horizontally directing said combustible mixture into the ignition zone for about 1 week.

4. The method of igniting an in situ oil shale retort as recited in claim 1 wherein said combustible inlet gas is horizontally directed into the ignition zone from at least two points.

5. The method of igniting an in situ oil shale retort containing a fragmented mass of particles containing oil shale, said in situ oil shale retort having an ignition zone extending across the in situ retort and a sufficient void volume distributed through the fragmented mass below the ignition zone for introducing inlet gas into the ignition zone and moving the gas through the fragmented mass below the ignition zone toward the bottom of the in situ retort, and further wherein, the ignition zone has a sufficient interconnected open space for movement of a volume of inlet gas through a volume of the ignition zone with less pressure loss than for the movement of a comparable volume of gas through a comparable volume of fragmented mass below the ignition zone, which comprises the steps of:

directing an oxygen supplying gas downwardly into the ignition zone;

directing a fuel horizontally into said ignition zone for mixing with oxygen supplying gas and producing a combustible mixture of fuel and oxygen supplying gas across the ignition zone;

igniting the combustible gas mixture for producing a self-sustaining combustion zone across the in situ oil shale retort in the fragmented mass below the ignition zone and generating flue gas in the combustion zone; and causing the flue gases generated in said combustion zone to move from the combustion zone toward the bottom of the in situ oil shale retort for establishing a retorting zone on the advancing side of the combustion zone.

6. A method for igniting a rubble pile of fragmented formation containing oil shale in an in situ oil shale retort comprising a cavity in a subterranean formation containing oil shale, said cavity containing a rubble pile of fragmented formation particles containing oil shale, comprising the steps of:

forming a rubble pile of fragmented formation particles containing oil shale in the cavity, said rubble pile having an ignition zone extending across the in situ retort with an average void volume higher than the average void volume of the fragmented rubble pile lower in the cavity;

directing an oxygen supplying gas into the ignition zone; and directing combustible fuel horizontally into the ignition zone for mixing with oxygen supplying gas for forming a combustible mixture in the ignition zone, and igniting the combustible mixture to form a horizontal flame across the in situ retort.

7. The method of claim 6 further comprising the additional step of directing combustible fuel horizontally into the ignition zone from an opposite side of the cavity from the first directing step.

8. A method of retorting oil shale retort in a subterranean formation containing oil shale, said in situ retort containing a fragmented mass of particles containing oil shale, said in situ oil shale retort having an ignition zone extending across the in situ retort and a sufficient void volume distributed through the fragmented mass below the ignition zone for introducing inlet gas into the ignition zone and moving the gas through the fragmented mass below the ignition zone toward the bottom of the in situ retort, comprising the steps of:

excavating a portion of the formation containing oil shale from the part of the formation to become the in situ oil shale retort to form at least one void and leaving a remaining portion extending away from such a void;

explosively expanding the remaining portion of the formation containing oil shale in the part of the formation to become the in situ oil shale retort to creat an in situ oil shale retort larger than the void and fill the in situ oil shale retort with the fragmented mass of particles containing oil shale;

forming an ignition zone in the fragmented mass of particles at the top of the in situ retort in which the fragmented mass of particles has a higher average void volume than the average void volume of the fragmented mass of particles containing oil shale further down in the in situ retort;

directing air into the ignition zone;

directing combustible fuel horizontally into the ignition zone for mixing with the air for producing a combustible mixture across the ignition zone;

igniting the combustible mixture for forming a self-sustaining combustion zone across the in situ oil shale retort in the fragmented mass below the ignition zone and generating flue gas in the combustion zone;

causing the flue gases generated in said combustion zone to move from the combustion zone toward the bottom of the in situ oil shale retort for establishing a retorting zone on the advancing side of the combustion zone wherein oil shale is retorted to produce liquid and gaseous products; and recovering liquid products near the bottom of the in situ oil shale retort.

9. The method of claim 8 wherein the ignition zone at the top of the fragmented mass of particles in the in situ oil shale retort is formed by removing fragmented particles from the top of the fragmented mass of particles in the in situ retort after explosively expanding.

10. The method of claim 8 wherein the ignition zone is formed by excavating a void near the top of the part of the formation to become an in situ oil shale retort before explosive expansion, and explosively expanding adjacent formation containing oil shale toward such void.

11. A method of retorting oil shale in an in situ retort comprising the steps of:

forming an in situ oil shale retort in an oil shale formation, said in situ retort containing a rubble pile of fragmented oil shale with an ignition zone at the top containing a portion of the rubble pile having a sufficient average void fraction for movement of inlet gas therethrough with lower gas flow resistance than the gas flow resistance of the portion of the rubble pile of fragmented oil shale in the cavity below the ignition zone;

igniting across the top of the in situ retort by directing a flame horizontally into the ignition zone from one side of the cavity for producing a self sustaining combustion zone in the rubble pile across the cavity;

introducing a combustion sustaining gas at the top of the in situ retort after a self-sustaining combustion zone is established in the rubble pile in the in situ retort for advancing the combustion zone through the rubble pile and producing flue gas, said flue gas carrying heat from the combustion zone through the rubble pile for producing and advancing a retorting zone in the rubble pile on the advancing side of the combustion zone wherein oil shale is retorted to produce liquid and gaseous products;

withdrawing off gas comprising said flue gas and said gaseous products from the bottom of the in situ retort; and recovering said liquid products from the bottom of the in situ retort.

12. A method of retorting oil shale in an in situ retort comprising the steps of:

forming an in situ oil shale retort in an oil shale formation, said in situ retort containing a rubble pile of fragmented oil shale with an ignition zone at the top having a sufficient interconnected open space for movement of inlet gas therethrough with lower gas flow resistance than the gas low resistance of fragmented oil shale in the cavity below the ignition zone;

igniting across the top of the in situ retort by directing a first flame horizontally into the ignition zone from one side of the retort and directing a second flame horizontally into the ignition zone from another side of the cavity for intersecting the first flame and producing a self-sustaining combustion zone in the rubble pile across the retort;

introducing a combustion sustaining gas at the top of the in situ retort after a self-sustaining combustion zone is established in the rubble pile in the in situ retort for advancing the combustion zone through the rubble pile and producing flue gas, said flue gas carrying heat from the combustion zone through the rubble pile for producing and advancing a retorting zone in the rubble pile on the advancing side of the combustion zone wherein oil shale is retorted to produce liquid and gaseous products;

withdrawing off gas comprising said flue gas and said gaseous products from the bottom of the in situ retort; and recovering said liquid products from the bottom of the in situ retort.

13. An in situ oil shale retort in a subterranean formation containing oil shale, which comprises:

a fragmented mass of formation particles containing oil shale bounded by unfragmented formation, said fragmented mass of particles having a first average void volume interspersed between the particles;

an ignition zone extending across the top of the fragmented mass of particles in the in situ oil shale retort having an average void volume interspersed between the particles greater than said first average void volume of the fragmented permeable mass;

means at a side of the ignition zone for directing a combustible inlet mixture of fuel and an oxygen supplying gas horizontally across the ignition zone; and access means at the bottom of the in situ retort for withdrawing retort off gases and liquids.

14. An in situ oil shale retort as defined in claim 13 wherein the average void volume of the portion of the fragmented mass of particles in said ignition zone is greater than about 30 percent of the total volume of said ignition zone.

15. An in situ oil shale retort as defined in claim 14 wherein the height of said ignition zone is from about 1 to 10 percent of the width of the in situ retort and the balance of the fragmented permeable mass of particles extending from the ignition zone to the bottom of the in situ retort has an average void volume of about 10 to 20 percent of the total volume of the in situ retort extending from the ignition zone to the bottom of the in situ retort.

16. An in situ oil shale retort as defined in claim 13 wherein the average void volume of the portion of the fragmented mass of particles in said ignition zone is about 30 to 50 percent of the total volume of said ignition zone, and the height of the ignition zone is about 5 percent of the width of the ignition zone.

17. An in situ oil shale retort as defined in claim 16 wherein the average void volume of the balance of the fragmented permeable mass of particles extending from the ignition zone to the bottom of the in situ retort has an average void volume of about 10 to 20 percent of the total volume of the in situ retort extending from the ignition zone to the bottom of the in situ retort.

18. An in situ oil shale retort in a subterranean formation containing oil shale comprising:

a fragmented mass of formation particles in such retort;

an ignition zone extending across the top of the fragmented mass of particles in the in situ retort with an average void volume higher than the average void volume of the fragmented mass of particles below the ignition zone;

means for directing a combustible ignition zone;

means for directing a combustible inlet mixture of fuel and an oxygen supplying gas into the ignition zone; and access means at the bottom of the in situ retort for withdrawing retort off gases and liquids.

* * * * *

UNITED STATES PATENT AND TRADEMARK OFFICE

CERTIFICATE OF CORRECTION

PATENT NO. : 4,027,917
DATED : June 7, 1977
INVENTOR(S) : William J. Bartel, Robert S. Burton, III It is certified that error appears in the above-identified patent and that said Letters Patent are hereby corrected as shown below:

Column 10, line 45, delete "means for directing a combustible ignition zone;".

Column 9, line 18, "low" should read -- flow --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*